United States Patent [19]

Ruff et al.

[11] Patent Number: 4,586,639

[45] Date of Patent: May 6, 1986

[54] SHEET MATERIAL DISPENSER AND METHOD OF DISPENSING SHEET MATERIAL

[75] Inventors: Stanley L. Ruff, New Rochelle, N.Y.; Albert Stubbmann, Franklin Lakes, N.J.

[73] Assignee: Clik-Cut, Inc., New Rochelle, N.Y.

[21] Appl. No.: 633,019

[22] Filed: Jul. 20, 1984

[51] Int. Cl.[4] ..... B26D 1/02; B26D 5/02; B65D 85/672

[52] U.S. Cl. ..... 225/1; 225/20; 225/43; 225/72; 225/85; 225/88; 225/90; 225/91

[58] Field of Search ..... 225/19, 20, 72–74, 225/90, 43, 91, 92, 88, 1, 2, 84, 85; 83/636, 915

[56] References Cited

U.S. PATENT DOCUMENTS

| | | | |
|---|---|---|---|
| D. 208,102 | 7/1967 | Brandon | D52/2 |
| 833,470 | 10/1906 | Lipowsky . | |
| 838,289 | 12/1906 | Weber . | |
| 1,907,922 | 5/1933 | Willis . | |
| 2,334,997 | 11/1943 | Doll | 206/58 |
| 2,484,673 | 10/1949 | Becker | 242/55.5 |
| 2,555,187 | 5/1951 | Erhardt | 225/19 |
| 2,613,879 | 10/1952 | Carr, Jr. | 242/55.5 |
| 2,663,369 | 12/1953 | Erhardt | 164/36 |
| 2,678,571 | 5/1954 | Booth | 76/101 |
| 2,746,546 | 5/1956 | Taylor | 225/74 |
| 2,766,877 | 10/1956 | Burbank | 206/58 |
| 2,771,186 | 11/1956 | Burbank | 206/58 |
| 2,776,095 | 1/1957 | Emmert | 242/55.5 |
| 2,802,527 | 8/1957 | Castelli | 164/43 |
| 2,850,157 | 9/1958 | Klein et al. | 206/58 |
| 2,861,753 | 11/1958 | Sipior | 242/55.51 |
| 2,888,180 | 5/1959 | Kinker, Jr. | 225/39 |
| 2,889,975 | 6/1959 | Hanlon | 225/19 |
| 2,921,493 | 1/1960 | Emmert | 83/611 |
| 2,992,582 | 7/1961 | Castelli | 83/611 |
| 3,006,567 | 10/1961 | Collins | 225/20 X |
| 3,011,688 | 12/1961 | Klein et al. | 225/47 |
| 3,028,060 | 4/1962 | Haley | 225/53 |
| 3,045,883 | 7/1962 | Andrews et al. | 225/90 |
| 3,088,640 | 5/1963 | Kunsch | 225/48 |
| 3,102,671 | 9/1963 | Gershen | 225/43 |
| 3,142,426 | 7/1964 | Busse | 225/43 |
| 3,144,970 | 8/1964 | Beschmann | 225/39 |
| 3,237,826 | 3/1966 | Ringholz et al. | 225/19 |
| 3,281,034 | 10/1966 | Woodling | 225/48 |
| 3,311,278 | 3/1967 | Brandon | 225/93 |
| 3,419,201 | 12/1968 | Brandon | 225/93 |
| 3,477,624 | 11/1969 | Branyon et al. | 225/43 |
| 3,510,033 | 5/1970 | Schramm et al. | 225/77 |
| 3,542,268 | 11/1970 | Schramm | 225/9 |
| 3,549,066 | 12/1970 | Wankow | 225/25 |
| 3,565,307 | 2/1971 | Wiley et al. | 225/47 |
| 3,625,100 | 12/1971 | Barnard | 83/205 |
| 3,845,894 | 11/1974 | Merlin | 225/25 |
| 3,915,364 | 10/1975 | Dieguez | 225/54 |
| 3,949,918 | 4/1976 | Golner et al. | 225/20 X |
| 3,991,923 | 11/1976 | Nishikawa | 225/20 |
| 4,085,878 | 4/1978 | Nausedas | 225/19 |
| 4,095,730 | 6/1978 | Clatterbuck | 225/48 |
| 4,196,647 | 4/1980 | Fish | 83/175 |
| 4,340,162 | 7/1982 | Heiman et al. | 225/48 |
| 4,450,996 | 5/1984 | Kamp | 225/43 |

FOREIGN PATENT DOCUMENTS

| | | | |
|---|---|---|---|
| 0011262 | 5/1980 | European Pat. Off. | 225/72 |
| 248753 | 11/1911 | Fed. Rep. of Germany . | |
| 2317210 | 2/1977 | France | 225/91 |
| 1256441 | 12/1971 | United Kingdom . | |

*Primary Examiner*—Frank T. Yost

*Attorney, Agent, or Firm*—Kirschstein, Kirschstein, Ottinger & Israel

[57] ABSTRACT

A free end portion of sheet wrapping material is grasped and pulled from a dispenser transversely past and spaced from a cutting element mounted on a housing. The cutting element is displaced in response to the movement of the withdrawn material by generating a displacement force, latching the cutting element against displacement in a normally guarded position in which the cutting element is inoperative for cutting, and thereupon unleashing the displacement force in response to a further movement of the material to drivingly displace the cutting element from the guarded position to a cutting position in which the cutting element is in a position to sequentially pierce and cut the sheet material that is subsequently moved toward the same. Methods of dispensing the sheet material and of wrapping items also are disclosed.

33 Claims, 9 Drawing Figures

SHEET MATERIAL DISPENSER AND METHOD OF DISPENSING SHEET MATERIAL

BACKGROUND OF THE INVENTION

1. Field of the Invention

This invention generally relates to a sheet material dispenser and, more particularly, to a novel dispenser for, and method of, efficiently and safely dispensing sheet wrapping material. Additionally, this invention relates to a novel cutting element for use in such dispensers as well as to a novel method of wrapping items.

2. Description of the Prior Art

Dispensers for sheet wrapping materials, such as plastic film, metal foil, waxed paper, paper, or similar wrapping stock, have been well known for both domestic and commercial use. The sheet material was generally wound about a supply roll mounted for rotation in a conventional polygonal container or box that was typically held in one's hand for domestic wrapping purposes, or that rested flatly on a supporting surface for commercial wrapping purposes.

The material was typically furnished in large-sized and large-capacity rolls having lengths of at least 100 ft. and sometimes 1000 ft. or longer, and having widths on the order of 12" or 18" and more, depending on the particular wrapping requirements. A free end portion of the material was generally grasped by a user with one or both hands, who then manually withdrew the material in a taut condition from the box and thereupon urged the material against a fixed, constantly exposed, cutting edge that was conventionally provided on the box, usually along one of the outer edges or walls of the same, in order to sever the material. The conventional cutting edge was serrated and had a row of generally triangularly-shaped teeth whose apices were colinear. Representative dispensers and cutting edges of this general type were disclosed, for example, in the following patents:

| | |
|---|---|
| U.S.L.P. 1,907,922 | U.S.L.P. 3,237,826 |
| U.S.L.P. 2,613,879 | U.S.L.P. 3,281,034 |
| U.S.L.P. 2,850,157 | U.S.L.P. 3,549,066 |
| U.S.L.P. 2,861,753 | U.S.L.P. 3,565,307 |
| U.S.L.P. 3,028,060 | U.S.L.P. 3,845,894 |
| U.S.L.P. 3,088,640 | U.S.L.P. 4,095,730 |
| U.S.L.P. 3,144,970 | |

Paper dispensers which did not use a box but, instead, mounted the roll of paper in a drawer, or on a wall mount or a board were disclosed, for example, in the following patents:

U.S. Pat. No. 833,470

U.S. Pat. No. 3,915,364

However, the satisfactory and safe dispensing of many sheet wrapping materials, particularly thin plastic films, has been the source of many difficulties. It is very desirable, particularly in repetitive commercial wrapping operations, to place the item to be wrapped directly in front, and in the center, of the dispenser which, in turn, is resting on a flat supporting surface. Thereupon, it is preferable to withdraw the plastic film in a taut condition from the dispenser above an upright cutting edge and to subsequently lower the taut film over the cutting edge to cut the film and, in the same downward motion, to lower the cut film onto the item to be wrapped.

However, experience has shown that when taut film was pulled downwardly at a right angle onto the planar, upright, serrated cutting edge whose teeth apices were colinear, it was difficult to cleanly and effortlessly cut the film in a single downward stroke. For user safety reasons, the height of the individual teeth on a conventional serrated cutting edge was made small, usually on the order of 1/16", as measured perpendicularly from the base of each tooth to its apex, and it had been found to require a great deal of initial force on the part of the user to start to sever the film when the entire width of the same is urged at once onto all the teeth. It was very difficult, if not virtually impossible, to urge the withdrawn film along its entire width at a right angle across the entire cutting edge and to effortlessly cut the film with a single downward stroke, especially when a film of substantial length and width was involved.

Hence, most users resorted to cutting the plastic film progressively from one side to the other, e.g. from right to left, across the width of the film in a sawing-type manner. The user thus tilted the film and presented it to the cutting edge in a fashion such that the plane of the taut film formed an acute angle with the cutting edge. With this cutting technique, however, the cut film did not immediately lie in a plane above the item being wrapped, but, rather, was located laterally offset to the side of the box, thus requiring the user to perform another motion, i.e. to bring the cut film back from its offset position to a position directly above the item being wrapped, and thereupon to lower it onto the item. This not only wasted time and required an additional wasted motion and effort, but also was made a much more difficult task due to the physical static cling properties of the plastic film itself. The plastic films, such as copolymers of vinylidine chloride and vinyl chloride, which are popular and well suited for wrapping purposes due to their clinging characteristics, also, unfortunately, have a great tendency to cling to themselves and the adjacent surfaces of their box and other adjacent surfaces. The self-clinging nature of the plastic film, aided by the ever-present electrostatic forces generated at the surface of the film during its withdrawal, caused the plastic film to adhere to itself. Moreover, when the plastic film was moved from its laterally offset position at the side of the box back to its desired central position directly over the item being wrapped at the center of the box, air currents were generated by this movement, and these air currents displaced the film and further aggravated the self-adhering problem and required the user, from time to time, to unpeel and pull apart the portions of the plastic film that clung together. This, of course, was time consuming, annoying, and terribly inefficient, particularly for repetitive commercial wrapping purposes.

Furthermore, the exposed cutting edge was a safety hazard which could severely cut and lacerate the user's hands, particularly when the user was compelled to work with a constantly exposed cutting edge, and had to exert a relatively large amount of force to initiate the cutting, as well as to apply a sawing motion to the material. An additional safety problem resided in the rough handling of dispensers. From time to time, it happened that a dispenser fell, or was shoved from one place to another. In either case, the exposed cutting edge could injure the worker who reached for the falling or shoved dispenser.

Aside from all of the aforementioned drawbacks, it was very difficult to obtain a clean straight cut across the entire width of the film. In most cases, the cut was askew, and the film was usually pulled and stretched to facilitate the cutting action. To remedy this situation, some users resorted to laying the withdrawn plastic film over the exposed cutting edge and then suddenly brought their hands down sequentially across the film in a karate-chop manner. Of course, by repetitively and forcefully bringing their hands down across the film near the exposed cutting edge, the safety problem was magnified.

Still another problem with prior art dispensers was the tendency on the part of plastic film to draw back into the box after being cut. It was somewhat awkward and inefficient to have to grope in the box for the loose free end when this occurred.

In an attempt to solve at least some of the aforementioned problems, it was disclosed in the prior art, for example, in

| | |
|---|---|
| U.S.L.P. 3,311,278 | U.S.L.P. 4,196,647 |
| U.S.L.P. 3,419,201 | U.S.Des.L.P. 208,102 |

to clamp the sheet material transversely at locations slightly in front of and behind a serrated cutting edge whose apices were colinearly arranged in a row transversely spanning the material, and thereupon manually to move the material relative to the cutting edge, or the cutting edge relative to the material, to cause the material to be severed in a guillotine-type manner across its entire width while clamped fore and aft of the cutting edge. However, the guillotine-type dispenser, although generally satisfactory in terms of properly positioning a cut film directly above the item being wrapped, has proven to be slow in operation because of the requirement of an extra manual motion. After the film was withdrawn from its box, it was necessary to effect the aforementioned fore and aft manual clamping and relative movement between the cutting edge and the material, typically by manually pushing down an actuator member hinged to an upper part of the box. In the event that the user employed both hands to withdraw the film, then the user was required to release the film to perform the extra manual downward movement. The guillotine-type dispensers were not only slow in use and expensive to manufacture, but also proved not to be sufficiently reliable, particularly in a commercial setting.

Dispensers of pressure-sensitive, strip-shaped tape, coupons, and the like were also well known, and were disclosed, for example, in the following references:

| | |
|---|---|
| U.S.L.P. 2,484,673 | U.S.L.P. 3,102,671 |
| U.S.L.P. 2,663,369 | U.S.L.P. 3,142,426 |
| U.S.L.P. 2,776,095 | U.S.L.P. 3,625,100 |
| U.S.L.P. 2,802,527 | U.S.L.P. 3,991,923 |
| U.S.L.P. 2,889,975 | British Patent No. 1,256,441 |
| U.S.L.P. 2,921,493 | German Patent No. 248,753 |
| U.S.L.P. 2,992,582 | Official Gazette, Vol. 767, June 13, 1961, page 290 |

However, dispensers for pressure-sensitive tape which typically have a cloth, paper or plastic backing, and a tacky adhesive on one or both sides of the backing, are structurally and functionally quite different from dispensers for sheet wrapping material due, in large part, to the different properties of the materials being dispensed. For example, the tape backings are made of a sturdy material, as opposed to the limp, non-self-supportable nature of thin, broad, sheet wrapping material, such as plastic film, metal foil, waxed paper, paper or the like.

SUMMARY OF THE INVENTION

1. Objects of the Invention

It is the general object of the present invention to overcome the aforementioned drawbacks of prior art dispensers of sheet material, particularly wrapping material.

It is another object of the present invention to withdraw a desired length of sheet wrapping material from a dispenser, to effortlessly cut the material and to have the cut material thereupon properly positioned over an item to be wrapped situated directly in front, and in the center, of the dispenser, all of said actions to be performed manually in a single, smooth, continuous pulling motion.

It is a further object of the present invention to eliminate the safety hazard wherein a user may severely cut or lacerate himself or herself on a constantly exposed, dangerous cutting edge.

It is a still further object of the present invention to expose the cutting edge for purposes of cutting the sheet wrapping material only when the user's hands are safely positioned remotely from the cutting edge.

It is yet another object of the present invention to expose the cutting edge only when the material is ready to be cut, and to shield the cutting edge and guard against cutting at all other times.

It is still another object of the present invention to reduce the manual effort required to initiate cutting of the sheet material, as well as to eliminate any side-to-side sawing-type action in order to sever the sheet material.

It is a further object of the present invention to eliminate the static cling problem characteristic of prior art dispensers for plastic film, and the concomitant problem of peeling apart portions of the withdrawn plastic film that cling to each other and/or to neighboring surfaces of the dispenser.

It is a still further object of the present invention to reduce the physical effort and time involved in wrapping items, particularly in commercial wrapping procedures.

It is yet another object of the present invention to reliably obtain a clean, substantially linear cut across the entire width of the sheet material in a single manual motion.

It is an additional object of the present invention to provide a novel cutting edge for effortlessly and cleanly severing sheet material wherein the cutting edge has a plurality of teeth whose apices are not parallel to the plane of the withdrawn sheet material or to the horizontal, and preferably are not colinear.

It is still another object of the present invention to eliminate the prior art necessity in guillotine-type dispensers of effecting an extra manual movement between the sheet material and the cutting edge to sever the material.

It is yet another object of the present invention to reliably maintain a free end portion of the sheet material in a readily available position so that it can be easily grasped, preferably by both hands.

It is a still further object of the present invention to eliminate the drawback problem associated with plastic film dispensers.

It is a further object of the present invention to provide a novel method of dispensing sheet material, as well as to provide a novel and efficient method of wrapping items.

It is another object of the present invention to provide a dispenser which is reliable, efficient and safe in operation, inexpensive to manufacture, easy to use, and durable.

2. Brief Description of the Invention

In keeping with these objects and others which will become apparent hereinafter, one feature of the invention resides, briefly stated, in a dispenser for, and a method of, dispensing sheet material, particularly wrapping material, such as plastic film, e.g. of the saran variety, metallic foil, e.g. aluminum foil, waxed paper, paper and analogous wrapping materials, all of which can be characterized as limp, non-self-supportable, thin, broad webs or sheets. The dispenser comprises an elongated cutting element and a guard element, both provided on a container, i.e. a support that is adapted to be placed on a supporting surface, e.g. a tabletop, a counter or a work surface. A supply of elongated sheet wrapping material is mounted on the support to permit a free end portion of the material to be grasped by a user, and to pay out a desired length of the material when the latter is manually withdrawn in a taut condition from the dispenser. A drag is exerted on the sheet material during its withdrawal to tension the material. In a preferred construction, the sheet material is provided in roll form and is coiled around a roll journaled for rotation within the support. Fan-folded sheet material also may be used as a supply. Means also is provided for initially guiding moving the desired length of the taut withdrawn material in a direction generally transverse to the elongated cutting element and past the same to a juxtaposed position spaced from the cutting element, and for subsequently guiding the withdrawn material from the juxtaposed spaced position onto the cutting element.

The dispenser further comprises means for displacing at least one of the elements, e.g. the cutting element, relative to the other, e.g. the guard element, in response to the movement of the withdrawn material. In a preferred embodiment, the displacing means includes arming, i.e. cocking, means for generating and storing a displacement force in response to one portion of the movement of the withdrawn material, latch means for normally latching against displacement the element to be displaced, e.g. the cutting element, and for maintaining the two elements in a normal position in which the guard element shields the cutting element, and release means for releasing the latch means and for unleashing the stored displacement force in response to another portion of movement of the withdrawn material to thereby drivingly relatively displace the two elements from their positions in which the guard element shields the cutting element to positions in which the cutting element is exposed and is able to cut the withdrawn material guided thereonto.

The arming means preferably includes a spring, and an arming member which is operatively connected to one end of the spring for the purpose of storing energy therein. The opposite end of the spring is normally anchored in position by the latch means until the stored energy in the spring is released by operation of the release means. Specifically, the latch means includes a force-transmitting member operatively connected to the opposite end of the spring and movable by the same, and a movable latch member engaging the force-transmitting member in a latched position and being disengaged from the force-transmitting member in an unlatched position. The force-transmitting member is operatively associated with a cam member on the displaceable element, e.g. the cutting element, to drivingly displace the cutting element to the cutting position. The latch member is moved by an actuator member of the release means, said actuator member triggering the force-transmitting member to the unlatched position only after the stored energy in the spring has reached a predetermined value, at which time, the free end portion of the sheet material has been withdrawn past and moved toward the cutting element. This ensures that the cutting element will be displaced suddenly with a pop-up action, and that the user's hands, which preferably grasp the opposite edges of the free end portion, will be well out of the way of the popped-up cutting edge.

Another feature of the invention resides in moving the taut withdrawn material, which generally lies in a plane, toward the cutting edge, which likewise generally lies in a plane, so that a right dihedral angle is formed between said planes. The right angle orientation constitutes an optimum cutting angle, and minimizes the effort and the time involved in performing the cutting action and performing the wrapping procedure.

Advantageously, the support has an inclined top wall which is substantially normal to the planar cutting element, and the taut withdrawn material is moved toward the inclined top wall during said other portion of the movement of the material.

In order to maintain the free end portion of the material in an accessible position so that it can be readily grasped, the dispenser includes a movable guide wall which resiliently presses and maintains the free end portion of the material between itself and a stationary wall on the support.

Still another advantageous feature of this invention is embodied in the cutting element itself which has a plurality of sharp, generally triangular, pointed cutting teeth, preferably, but not necessarily, of relatively large height, e.g. on the order of $\frac{3}{8}''$ as measured perpendicularly from the base of the tooth to its apex, arranged in juxtaposition lengthwise along the cutting element. In contrast to prior art cutting elements, the apices are not colinear along a line parallel to the horizontal, but inclined thereto, preferably reaching a maximum height between the ends of the cutting element, although the cutting element will perform well with either or both ends at raised elevations or with two or a few intermediate raised elevations of the line joining the apices. As the withdrawn material is initially moved vertically downwardly onto the apices, adjacent ones of which are at different vertical elevations, i.e. vertically spaced apart, the material is sequentially pierced at spaced-apart locations transversely across the material width. Thereupon, during continued vertical downward movement onto the vertically spaced apart apices, additional piercings or punctures are formed across the width, and each puncture is, in turn, widened until the material has been completely severed across its entire width.

Hence, in accordance with this invention, any desired length of sheet material can be easily grasped at the opposite edges of its free end portion, withdrawn and guidably moved from the dispenser, and positioned at an elevated spacing above the cutting edge; thereupon, the sheet material, in a continuous motion, can be moved downwardly toward the cutting edge, and in a direction which is essentially at a right dihedral angle to the cutting edge; the cutting element is displaced and raised to its unshielded (exposed) position prior to the sheet material making cutting contact with the cutting element; thereupon, the continued downward movement of the sheet material down onto and past the cutting element causes the material to be sequentially pierced and effortlessly and quickly cut; and the cut material then can be lowered, continuing the same downward motion, and quickly and properly positioned over an item to be wrapped located directly in front, and in the middle, of the dispenser. All of the aforementioned motions are manually performed in a single, smooth, continuous, pulling manner without wasted effort, without sawing the material from side to side, without having to peel apart clung-together portions of the material, and without any extra manual movement. Also, the dispenser of this invention is safe to use, because the cutting element is normally in its shielded position except when it is momentarily exposed in its exposed cutting position, at which point, both the user's hands are safely out of the way of, and past, the exposed cutting element.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
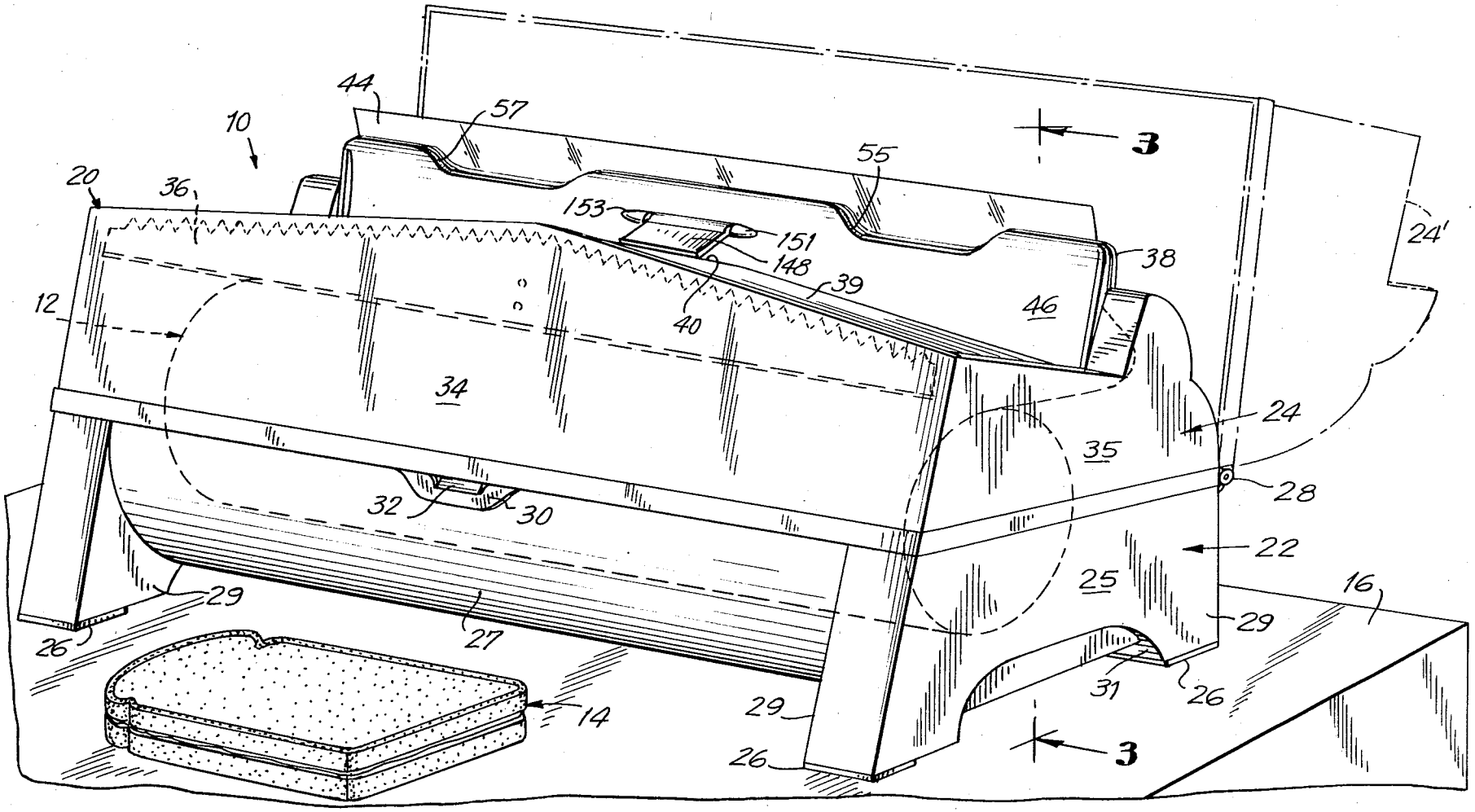
FIG. 1 is a front perspective view of a dispenser in accordance with this invention for use in wrapping an item, particularly one placed in front of the dispenser, and showing a top portion of the dispenser in its open position with the use of phantom lines.

Referring now to the drawings and, more particularly, to FIG. 1 thereof, the reference numeral 10 generally identifies a dispenser for dispensing sheet wrapping material 12 to be used in wrapping an item 14, preferably, but not necessarily, placed directly in front of the dispenser on a supporting surface 16 such as a planar countertop or tabletop. The sheet wrapping material 12 is a limp, non-self-supportable, thin, broad web, and may be any clinging or non-clinging plastic film, such as a copolymer of vinylidine chloride and vinyl chloride (of the saran variety), a metallic foil such as aluminum foil, waxed paper, paper or analogous wrapping stock. The aforementioned webs are typically on the order of from ½ to about 2 mils thick, although different thicknesses may be employed. The aforementioned webs are typically on the order of either 12" or 18" wide, although smaller webs on the order of 8" and 10", and larger webs greater than 18" are also within the scope of this invention. Such webs are semi-fragile in that they may be easily pierced and cut by a rigid or semi-rigid cutting edge which can be constituted of metal, plastic or an analogous hard edge, by manually urging the web against the cutting edge, or vice versa.

Although the item 14 to be wrapped is depicted in FIG. 1 as a sandwich, many diverse objects of all shapes and sizes can be wrapped, including, without limitation, any foodstuff, non-foodstuff, bowls, trays, utensils, etc. Any inanimate object desired to be wrapped which is unaffected by and does not affect the wrapping material used can be successfully wrapped by the dispenser of this invention.

In accordance with this invention, the dispenser 10 includes a support or housing 20 having a base portion 22 and a top portion or lid 24, each portion having walls bounding an interior space 23 in which a supply of the sheet material 12 is received. The base portion 22 has a pair of lower planar side walls 25, and a semi-cylindrical base wall 27 intermediate the side walls 25. The base portion 22 also has a set of four upright legs 29 for supporting the base wall 27 at an elevation over the supporting surface 16. A non-skid friction pad 26 is mounted at the underside of each leg 29 for preventing the housing from being undesirably shifted forwardly, i.e. toward the item 14 being wrapped during the withdrawal of the material. Rubber suction cups or the like can be used instead of non-skid pads 26. A recess 31 is formed between each pair of legs 29 on either side of the housing 20, and serves as a convenient handhold to pick up and transport the housing from place to place.

The top portion 24 is hinged on the base portion 22 at the rear of the housing by a pair of rear hinges provided on either side of the housing. The top portion 24 is movable relative to the base portion 22 between a closed (solid line in FIG. 1) position in which access to the interior of the housing is denied, and an open (phantom line in FIG. 1) position 24' in which interior access is gained, usually for the purpose of replacing a spent supply of sheet material with a fresh supply.

Figure 3:
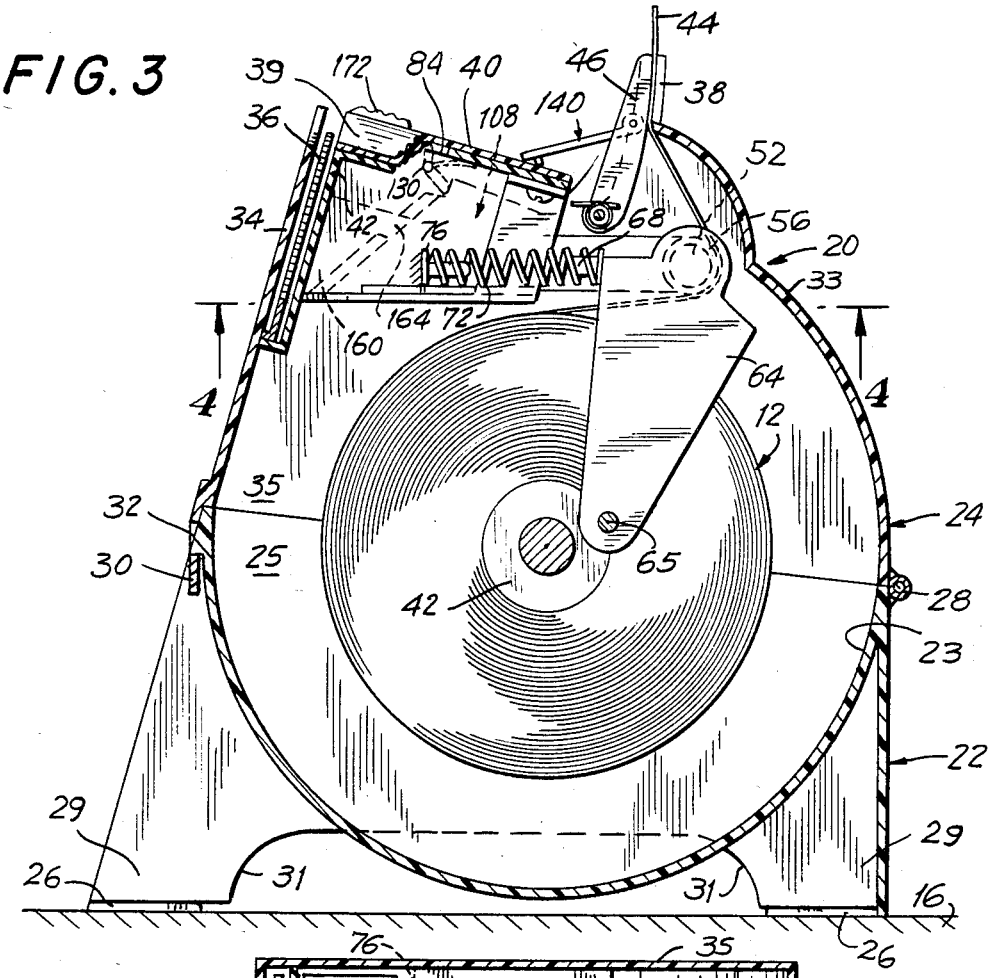
FIG. 3 is an enlarged cross-sectional view taken substantially along line 3—3 of FIG. 1.

The top portion 24 includes a planar front wall 34 which slopes rearwardly and upwardly (see FIG. 3) and which, as described below, serves as a guard element for a planar cutting element 36 mounted on the housing behind the front wall 34 in a plane generally parallel thereto. The front wall 34 has a generally triangular top edge with an apex located at its central region. The top portion 24 also has a pair of upper planar side walls 35 coplanar with the lower side walls 25 of the base portion 22. As best shown in FIG. 3, the top portion 24 also includes a rear wall 33. The top portion 24 also includes a transverse upright wall 38, i.e. lip, extending upwardly above the rear wall 33, and a top wall which is comprised of three portions—a central planar top wall portion 40 which is rearwardly and downwardly inclined and which lies in a plane which defines a right angle relative to the plane of the front wall 34 as well as to the plane of the cutting element 36, and a pair of tapered end wall portions 39, 41 (see FIG. 6) extending downwardly transversely from the top wall portion 40 to the respective upper side wall 35.

A sub-chassis 80 (see FIG. 2) is detachably mounted below the top wall 39, 40, 41, and is comprised of a central planar wall portion 82 which underlies and is connected to top wall portion 40 by screws 123, 123' (see FIG. 6) and a pair of generally L-shaped end wall portions 84, 86 which underlie and are connected to end wall portions 39, 41, respectively, by screws passing through openings 84', 86' (see FIG. 2) and threadedly engaging tapped holes in the end wall portions 39, 41. The sub-chassis 80 also comprises a planar wall 42 which is rearwardly offset from the front wall 34 and defines therewith a thin pocket in which the cutting element 36 is received when hidden in its shielded position.

A snap-action lock for locking the top portion 24 to the base portion 22 in the closed position includes a U-shaped hasp 30 integral with a perimetral rim on the top portion 24 at a central lower region of the front wall 34, and an outwardly projecting tang 32 integral with a central front region of the base wall 27. The hasp 30 resiliently engages the underside of the tang when snapped thereover in the closed position, and in order to release the locking action, the hasp 30 is manually grasped and pulled outwardly forwardly to clear the tang. The front surface of the tang is sloped downwardly and forwardly to cam the hasp outwardly over it when the top portion is swung to closed position.

The overall shape of the housing is generally pyramidal. The housing is preferably injection-molded of a light-weight, high-impact-resistant synthetic plastic material.

The sheet material 12 is preferably provided in roll form and is coiled about a cylindrical roll 42 mounted for rotation within the housing about a horizontal axis. A pair of journals are provided at opposite sides of the housing and are operative for rotatably receiving a pair of axial end portions of the roll. In some applications, the roll 42 has a hollow core, and a pair of stub shaft inserts are inserted into each open axial end of the roll for rotatably receiving the roll in the housing journals. Differently-sized inserts can accommodate rolls of different width. The sheet material may have any unrolled length, and is frequently furnished in lengths on the order of 100 ft., 1,000 ft. and more. A free or loose end portion 44 of the sheet material is passed from the interior 23 of the housing to its exterior, and is positioned at a readily accessible location such that the free end portion 44 may be conveniently grasped by a user and manually pulled out of the dispenser. The material quickly spreads automatically as it passes over a movable guide wall 46 soon to be described, after which the side edges of the material may be grasped to pull the material out flat and taut and to occupy both hands of the user. The material is manually pulled out in a taut condition each time it is to be dispensed until any desired length of the material has been withdrawn. During the withdrawal of the material, means including the movable guide wall 46 is provided for initially guiding the material in a path extending forwardly in the direction of the arrow A (see FIG. 7) above the inclined top wall 39, 40, 41 and the cutting element 36, and for continuing the advancement of the sheet material until the desired length thereof has been withdrawn past the front wall 34. Thereupon, as explained in further detail below, the taut withdrawn material is moved downwardly toward the inclined top wall 39, 40, 41 in the direction of the arrow B (see FIG. 8) onto a cutting edge of the then-exposed cutting element 36. Either or both of these two movements of the sheet material, i.e. the initial forward movement and the subsequent downward movement and during which the material engages the guide wall 46, are performed in a smooth, continuous, single-action manner, and may be employed, as explained below, to displace, in a preferred embodiment, the cutting element 36 from its shielded position (for example, see FIG. 7) to its cutting position (see FIG. 8).

The guide wall 46 extends substantially across the entire width of the housing, and is pivotably mounted for forward movement from a rear clamping position (see FIGS. 3 and 5) in which the free end portion 44 is clamped and frictionally held between the guide wall 46 and the rear transverse wall 38 which is stationary during forward pivoting of the guide wall, to a plurality of forward non-clamping positions (see, for example, FIGS. 7 and 8) in which the withdrawn material is freely guided on and along the guide wall 46 which, for this purpose, is advantageously of a smooth, arcuate configuration.

In addition, means, preferably a pair of torsion coil springs 47, 49 (see FIG. 2), are mounted between the sub-chassis 80 and the guide wall 46 for constantly restorably urging the latter to the rear clamping position. Specifically, each coil spring 47, 49 has one end received in a blind bore at a side of the guide wall, and an opposite end which bears against a respective adjacent upright flange 43, 45. The flanges 43, 45 are integral with the end wall portions 84, 86, respectively, of the sub-chassis. A pair of threaded pins or fasteners 51, 53 extend through clear openings formed in the flanges 43, 45, and also through the open centers of the springs 47, 49 and are received in tapped blind bores in the ends of the guide wall 46 to anchor the same in place. The guide wall 46 is also formed with a pair of broad, shallow notches 55, 57 in its top edge spaced apart from each other, and operative to provide access to the clamped sheet material at spaced-apart locations across the width of the dispenser so as to permit the user to readily grasp the clamped material with both hands.

Figure 2:
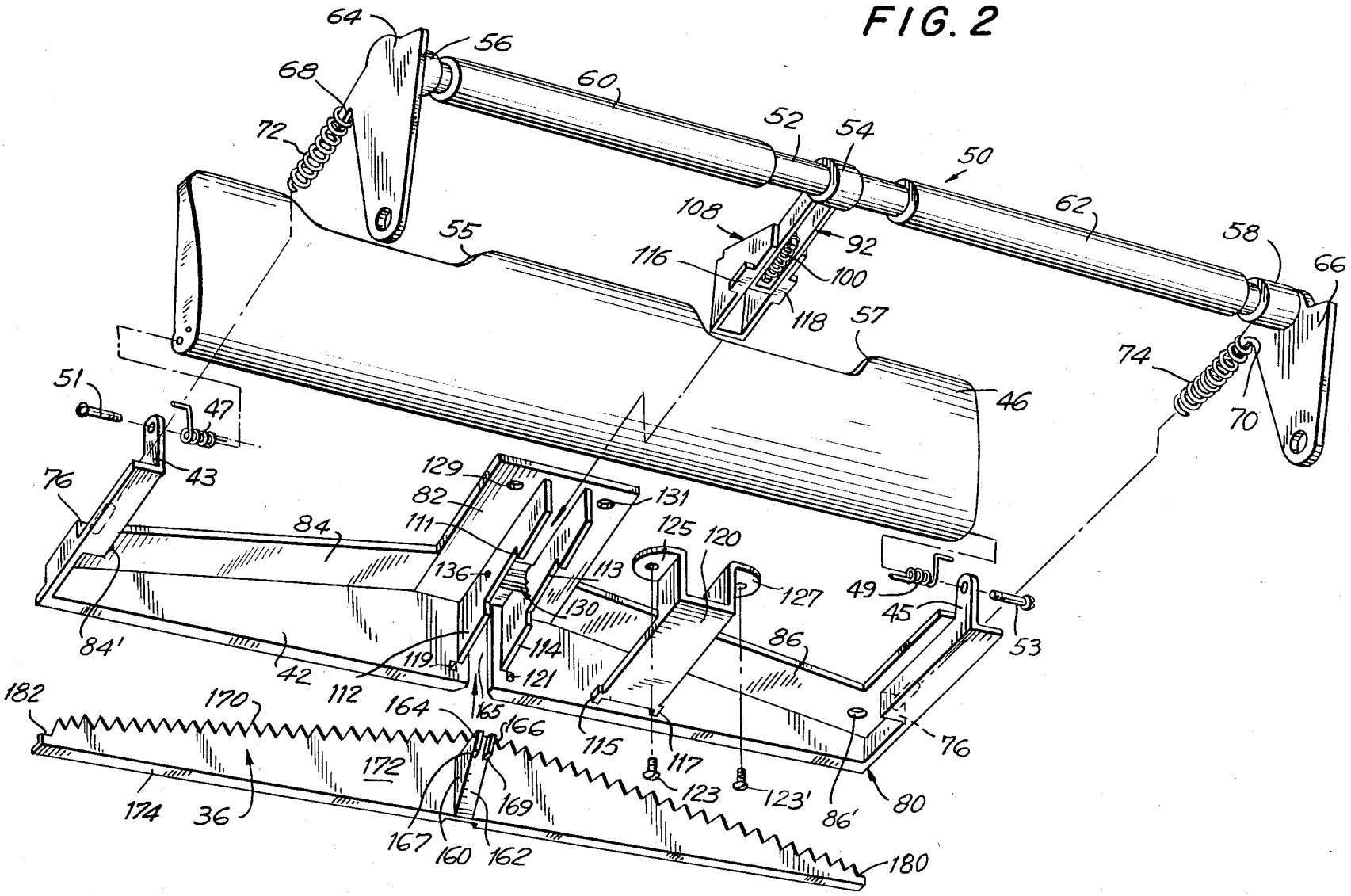
FIG. 2 is an exploded view of various components of the dispenser as seen from its interior and below and behind the interior components.
Figure 4:
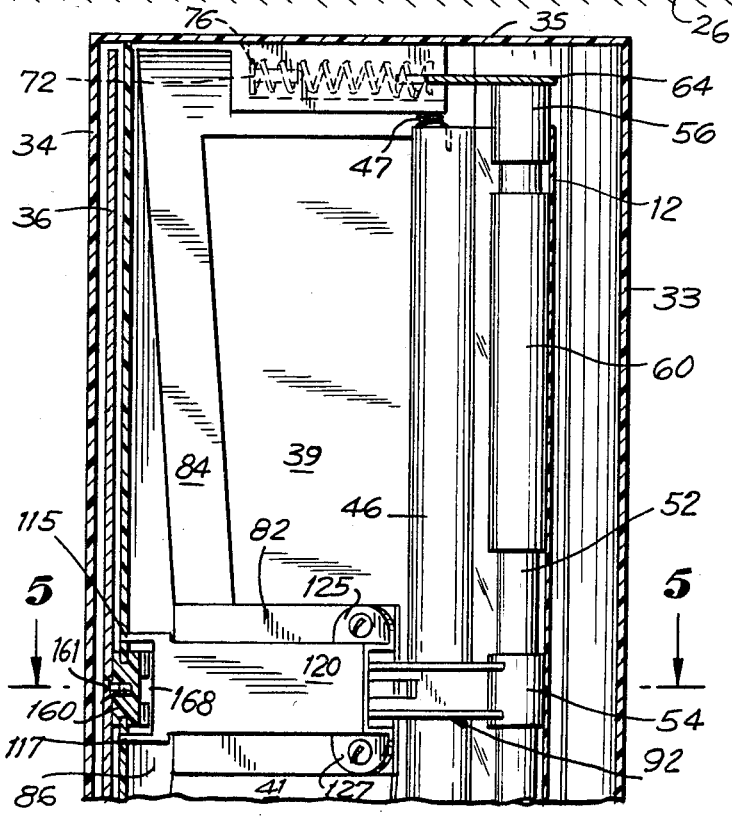
FIG. 4 is a fragmentary plan view taken substantially along the line 4—4 of FIG. 3.

Displacing means are provided for displacing, relative to each other, at least one of the guard element 34 and the cutting element 36 and, in the preferred embodiment, it is the cutting element which is displaceable from its normally guarded (shielded) position in which the guard element renders the cutting element inoperative for cutting due to the retracted position of the cutting element behind the guard element. The upper edge of the guard element is above the upper edge of the cutting element in the guarded position, thereby mechanically interfering with anything directed onto the cutting element. As best shown in FIGS. 2 and 4, the displacing means includes arming means 50 for generating a displacement force in response to, at least a portion of, the initial guided forward movement of the sheet material. This displacement force is later unleashed in response to a further movement of the sheet material, this being preferably at least a portion of the subsequent downward movement toward, but terminating short of, the cutting element. The unleashed displacement force is the driving force which displaces the cutting element to its exposed cutting position.

The arming means 50 includes a cylindrical shaft 52 extending along a horizontal axis, a central annular collar 54 centrally located on and surrounding the shaft 52 with a slight clearance, a pair of tubular fittings 56, 58 for interiorly receiving the opposite axial ends of the shaft 52, and a pair of freely-turnable tubular rollers 60, 62 mounted loosely about the shaft 52 intermediate the collar 54 and a respective fitting 56, 58. The fittings 56, 58 are respectively connected to pivot bracket arms 64, 66 which are pivotably mounted on pivot pins 65 (see FIG. 3). The arms 64, 66 respectively have a forward extension 68, 70 which extends through the open centers of return coil springs 72, 74. One end of each spring 72, 74 bears against its respective arm 64, 66, and the opposite end of each spring bears against a pair of abutments 76 provided on the sub-chassis 80. Each spring 72, 74 is operative to constantly restorably urge the shaft 52 and all the aforementioned components operatively connected thereto rearwardly to an unarmed position (as shown in FIG. 5) adjacent the rear wall 33.

Figures 5, 6:
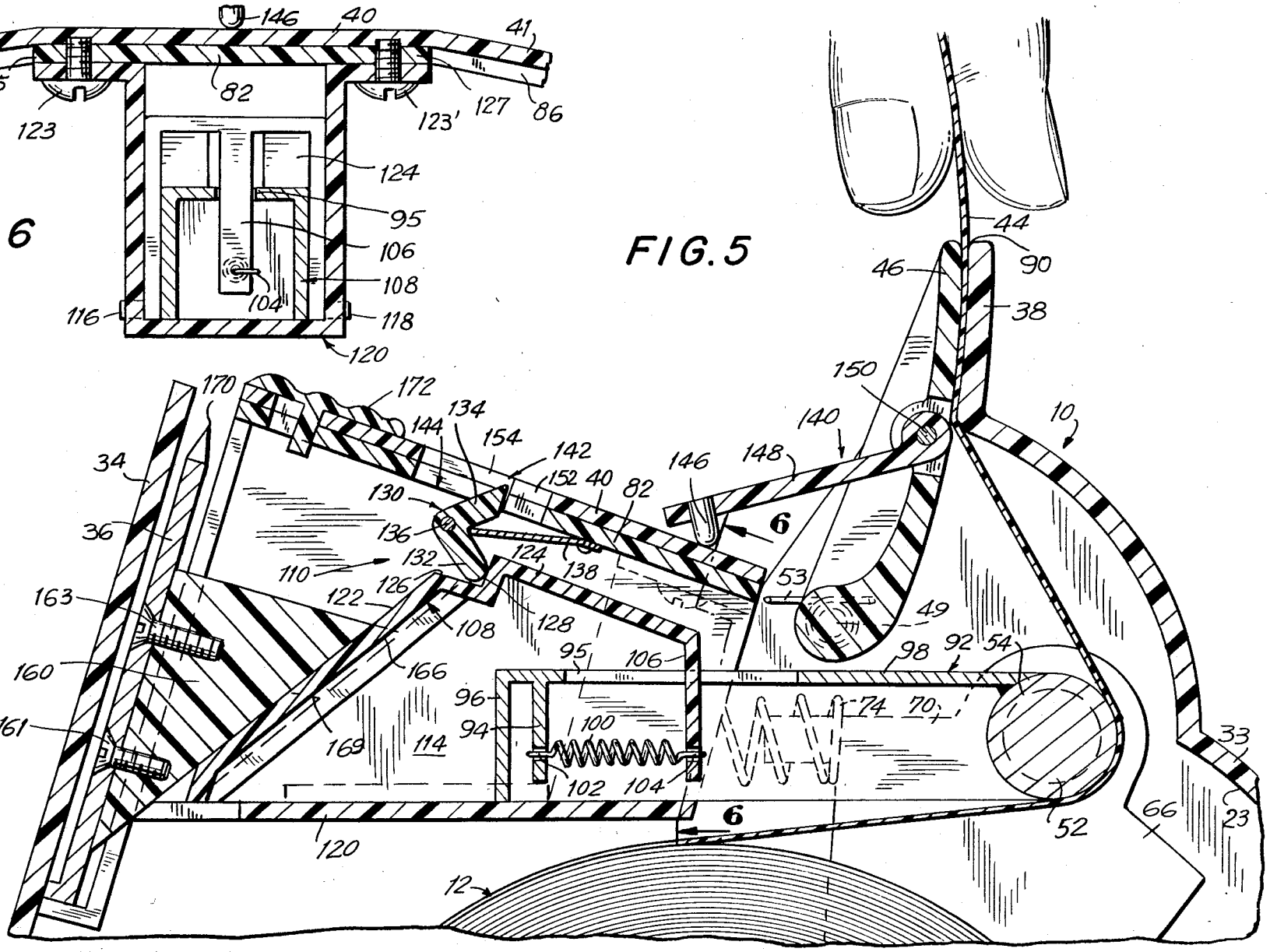
FIG. 5 is an enlarged partially broken away cross-sectional view taken substantially along line 5—5 of FIG. 4 showing the arrangement of various components at a beginning stage of the withdrawal of the sheet material from the dispenser wherein the sheet material is grasped by a user.
FIG. 6 is a fragmentary view taken substantially along line 6—6 of FIG. 5.

The sheet material 12 is wound clockwise, as seen in FIG. 5, on its supply roll. The material 12 is unwound from the top of its supply roll 42 and is routed in a counterclockwise direction around the rear side of the rollers 60, 62 of the arming means en route to an exit opening 90 formed between the movable guide wall 46 and the stationary wall 38. The rollers 62, 64 are located rearwardly of an imaginary line drawn from the exit opening to the top of the roll 42. As the free end portion 44 of the sheet material is withdrawn forwardly through the exit opening 90, the following portion of the sheet material is tensioned by the drag caused, in part, by the inertia of the wound roll and the friction of the sheet material engaged with the dispenser. The tensioned film, as it is being forwardly guidably moved on and along the guide wall, pivots the guide wall 46 forwardly and, due to its engagement with the rear side of the rollers 60, 62, also forwardly moves the shaft 52 and all the aforementioned components operatively connected thereto. The rollers 60, 62 are moved toward the aforementioned imaginary line. Advantageously, to reduce rolling friction, the freely turnable rollers 60, 62 turn about the shaft 52 during this forward withdrawal movement of the material in its tensioned state.

The arming means also includes a forwardly extending container 92 of one piece with the central collar 54 and jointly movable therewith. The container 92 has a downwardly extending projection 94 (see FIGS. 5, 7 and 8) adjacent its front end wall 96 and a forwardly extending clearance slot 95 formed lengthwise along its top wall 98. An energy-storing stretchable spring 100 is mounted within the container 92, and has one end 102 hooked into an opening formed in the projection 94. The other end 104 of the spring is hooked into an opening formed in a downwardly extending rear wall 106 of a force-transmitting or drive member 108. The rear wall 106 is generally parallel to the projection 94, and extends through the slot 95 for movement lengthwise of the same. It will be observed from FIG. 7 that when the rear wall 106 is anchored or fixed in position and, thereupon, when the front projection 94 is moved forwardly, the spring 100 is stretched in the direction of the arrow C, thereby storing energy in the spring.

The displacing means also includes latch means 110 (FIG. 5) for normally latching the cutting element 36 against displacement, and release means 140 for releasing the latch means and for unleashing the energy stored in the spring 100 to thereby drivingly displace the cutting element upwardly to its exposed cutting position. The latch means includes the aforementioned drive member 108 mounted for forward sliding movement in a space bounded by a pair of confining walls 112, 114 (see FIG. 2). Each confining wall has a lower longitudinally extending slot 111, 113 in which a respective transversely extending lug 116, 118 integral with and extending outwardly from opposite sides of the drive member 108 is received for movement lengthwise of its respective slot.

A cover 120 underlies the interior space bounded by the confining walls 112, 114 and the central top wall portion 82 of the sub-chassis 80. The cover 120 has a pair of front projections 115, 117 which are respectively inserted into openings 119, 121 formed in the front wall 42 of the sub-chassis 80. The cover is secured in place by fasteners 123, 123' which extend through holes formed in outwardly extending ears 125, 127, and through juxtaposed holes 129, 131 formed in the central planar top wall portion 82, and which are threaded into tapped holes in the central top wall portion 40.

The drive member 108 has, in addition to its rear wall 106, a front wall 122 which is rearwardly and upwardly inclined, a top wall 124 which is rearwardly and downwardly inclined, a ledge wall 126 and an abutment wall 128. The ledge and abutment walls 126, 128 together form a frontwardly open cavity in which a leg 132 of a V-shaped latch member 130 is normally latchingly received. The apex of the latch member 130 is pivotably mounted on pivot pin 136 for movement between a normally latched position, as shown in FIGS. 5 and 7, wherein the leg 132 engages the abutment wall 128 (just barely in the FIG. 7 position) and prevents the same, as well as the entire drive member 108, from moving forwardly during the withdrawal of the sheet material, and an unlatched position, as shown in FIG. 8, wherein the leg 132 is disengaged from the abutment wall 128 and permits the drive member 108 to be moved forwardly.

A leaf spring 138 having one end connected to the underside of the top wall portion 82 has its opposite end resiliently bearing against the latch member 130 and is arranged to constantly restorably urge the same to the normally latched position. The other leg 134 of the latch member 130 extends upwardly into juxtaposed openings 142, 144 formed in the juxtaposed top wall portions 40, 82, respectively, and into the path of movement of a trigger pin 146 mounted on a release lever 148 of the release means 140. As shown in FIG. 1, the release lever 148 is pivotably mounted on the front side of the guide wall 46 at a central region thereof for pivoting movement about a pivot pin 150 whose opposite ends are journalably mounted in raised bearings 151, 153. As shown in FIG. 5, the tip of the trigger pin 146 normally rests on the inclined top wall portion 40.

When the sheet material is withdrawn and initially pulled forwardly, and concomitantly subsequently downwardly toward, but short of, the cutting edge, the tensioned material pivots the guide wall 46 downwardly about the horizontal axis defined by the aforementioned pivot pins 51, 53 (see FIG. 2) and the tensioned material likewise pivots the pivot pin 150 to orbit about said horizontal axis defined by said pins 51, 53. During this forward and downward movement, the trigger pin 146 rides upwardly and forwardly along the inclined top wall portion 40 until the trigger pin 146 descends, assisted by gravity, into a rear cavity 152 of the opening 142. The opening 142, as seen from above the dispenser, is generally T-shaped, and the stem of the T constitutes the rear cavity 152. The trigger pin 146 is received with slight clearance in cavity 152, and is reliably guided without undesirable transverse shifting toward a front cavity 154 of the T-shaped opening 142, said front cavity 154 constituting the cross bar of the T.

Figure 7:
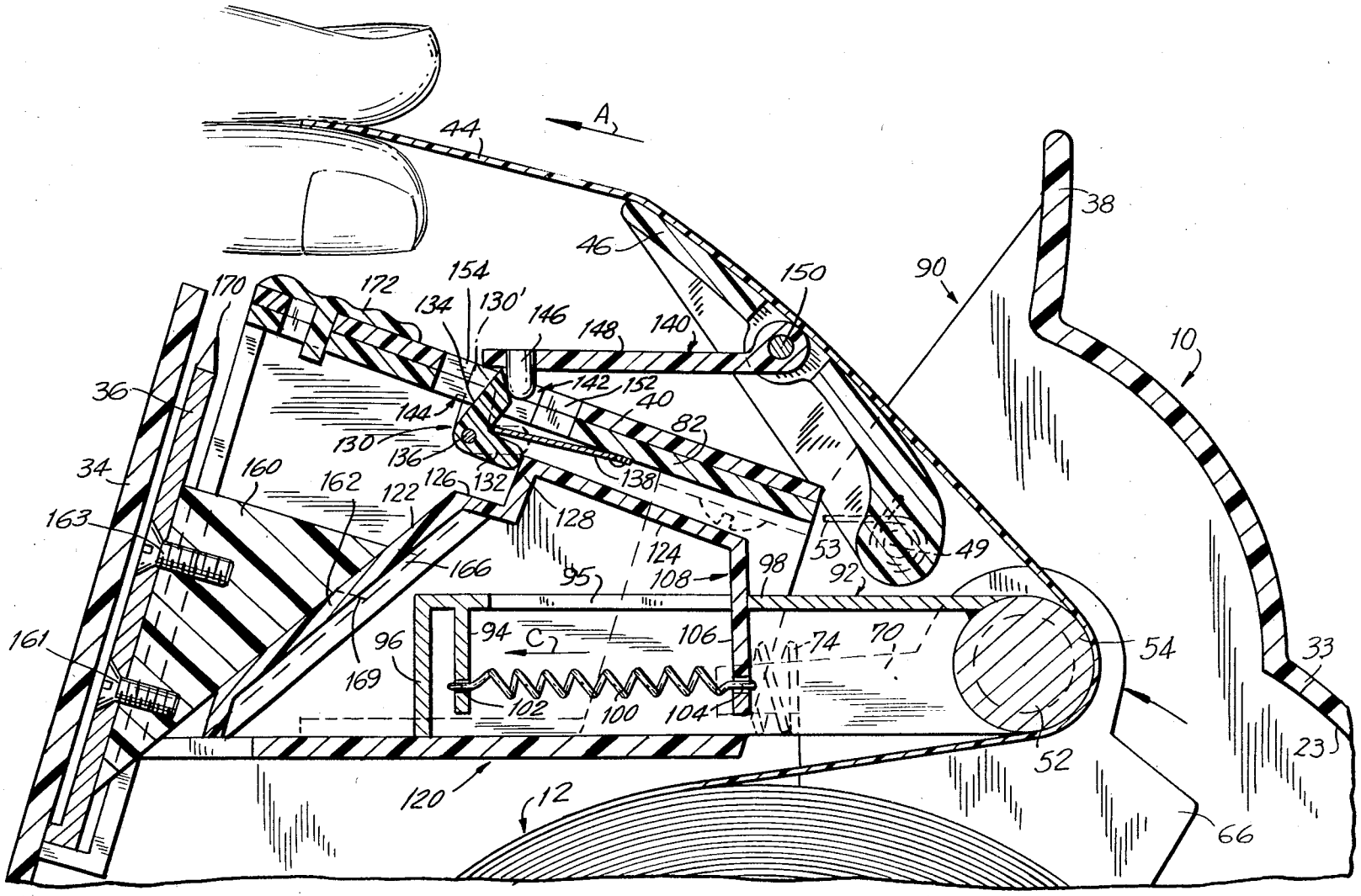
FIG. 7 is a view analogous to FIG. 5 but showing the arrangement at a subsequent stage of the withdrawal of the material.
Figure 8:
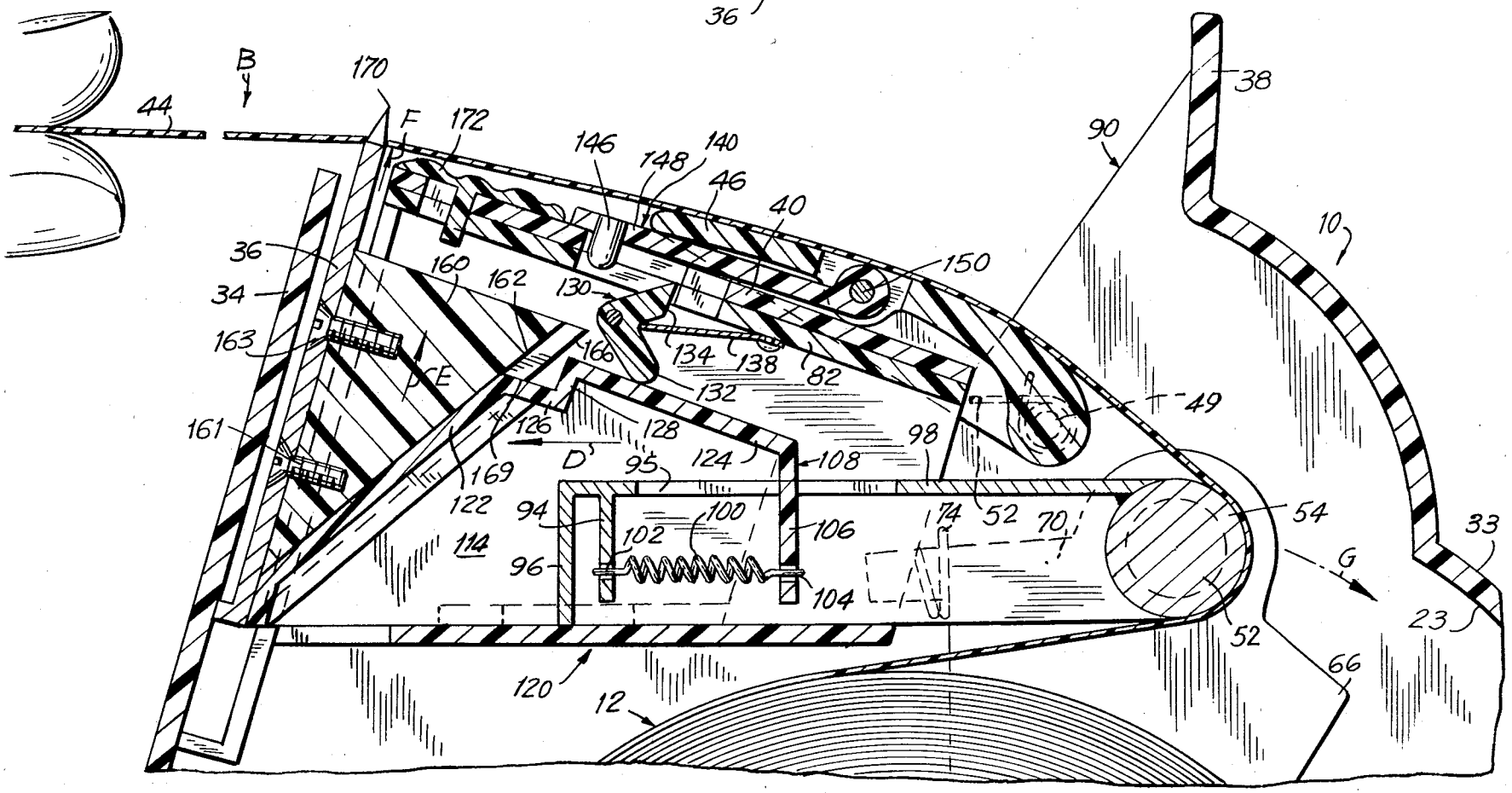
FIG. 8 is a view analogous to FIG. 7 but showing the arrangement at a further subsequent stage of the withdrawal of the material, wherein the sheet is being cut.

The trigger pin 146 continues its forward and upward movement along the guide opening 142, now not riding on the top wall portion 40, until, as shown in FIG. 7, the trigger pin engages the top of the leg 134. Thereupon, the continued withdrawal of the sheet material and its movement in the forward and downward directions drives the trigger pin 146 and, in turn, the leg 134 forwardly, and causes the latch member 130 to pivot counterclockwise (as viewed in FIG. 7) about its pivot axis 136 to its dashed line position 130', thereby raising the leg 132 until the latter is disengaged from and clears the abutment wall 128. At this point, the drive member 108 is no longer latched or anchored in position by the latch member 130 so that the stretched spring 100 suddenly pulls the drive member 108 forwardly. It is advantageous if the leg 134 does not extend upwardly past the upper major surface of the inclined top wall portion 40 to prevent the user from inadvertently touching the leg 134 and accidentally tripping the latch member 130 and releasing the drive member 108.

The cutting element 36 has a wedge-shaped cam member 160 fixedly connected at its rear side with threaded fasteners 161, 163. As shown in FIG. 2, the cam member 160 extends through a central cut-out 165 in the front wall 42 of the sub-chassis 80, and has an upwardly and rearwardly inclined cam wall 162 which engages the inclined front wall 122 of the drive member 108. A pair of guide tracks 164, 166 extend at least partly along the length of the cam wall 162. The guide tracks 164, 166 bound therebetween a track in which a corresponding guide projection 168 (see FIGS. 3 and 4) on the inclined front wall 122 is slidingly received with a slight clearance. Each guide track 164, 166 also has a lower locking shoulder 167, 169.

As the drive member 108 is displaced forwardly by the spring 100 (in the direction of the arrow D) whose stored energy has suddenly been unleashed by the tripping of the latch member 130, the front wall 122 is driven and forced underneath the inclined cam wall 162, thereby raising the cam member 160 in the direction of the arrow E (FIG. 8) and, of course, the cutting element 36 is simultaneously raised in the direction of the arrow F to its raised cutting position, as best shown in FIG. 8. The sudden, abrupt release of the drive member 108 causes the cutting element 36 to be raised in a pop-up manner. The guide tracks 164, 166 ensure that the cutting element will be positively and reliably raised without undesirable transverse shifting lengthwise of the cutting element.

In the cutting position, the locking shoulders 167, 169 rest on and engage the ledge wall 126, and are operative to maintain the cutting element 36 in a defined cutting position for as long as the ledge wall 126 is maintained in its forward position.

After the cutting element 36 has been raised, the continued downward guided movement of the sheet material in the direction of the arrow B in FIG. 8, toward the inclined top wall portion 40, onto a cutting edge 170 of the cutting element causes the material to be severed as described in further detail below.

The cutting edge 170 (see FIG. 9) comprises a plurality of planar, pointed, generally triangular cutting teeth which preferably lie in a common plane. At the zone of cutting, the plane in which the taut withdrawn material lies is generally perpendicular to the plane of the cutting teeth. To achieve this optimum cutting angle, it will be noted that the guide wall 46 rests on and lies generally parallel to the release lever 148 which, in turn, rests on and lies generally parallel to the inclined top wall portion 40 which, as noted previously, is inclined generally perpendicularly to the plane of the cutting element 36. The trigger pin 146 has been driven past and is located forwardly of the latch member 130, and the latch member has been returned to its original position by the restoring action of the leaf spring 138.

The cutting teeth are operative to sequentially pierce and cut the pulled-down sheet material over its entire width in a single, smooth, pulling stroke. Once the sheet material has been cut, there no longer is any force being forwardly exerted at the rear of the shaft 52 by the sheet material, so that the restoring springs 72, 74 take over and urge the shaft 52 and all of the components operatively connected thereto in the direction of the arrow G in FIG. 8 back to their unarmed position adjacent the rear wall 33. This restoring action is assisted by the restoring springs 47, 49 which act to return the guide wall 46 back to its normal clamping position adjacent the stationary wall 38. Once the ledge wall 126 is retracted from underneath the locking shoulders 167, 169 of the cam member, the cam member 160 and the cutting element 36 fall back under the influence of gravity to their normally guarded position. As shown in FIG. 8, in the cutting position,the user's fingers are well away from the cutting edge 170, thereby promoting user safety.

An auxiliary feature of the invention resides in a slidable safety member 172 mounted for sliding movement on the inclined top wall portion 40 between a safety position as shown in FIG. 8 wherein the cutting element 36 is free to be raised and/or lowered without mechanical interference by the safety member 172, and a covered position wherein the safety member overlies the cutting element 36 and mechanically prevents the same from being raised. The safety member 172 has a raised transversely ribbed surface to facilitate the user moving the same, particularly when the dispenser is to be transported from place to place.

The operation of the dispenser is believed to be evident from the discussion given above in connection with the structural and functional features of the dispenser. However, for the sake of completeness, the following brief description of the operation of the dispenser is provided.

Once the item 14 is properly positioned in front of the dispenser, a user, with both hands spaced apart, grasps the clamped free end portion 44 of the material at access notches 55, 57 and pulls the material forwardly in the general direction of the arrow A of FIG. 7. This forward pulling movement of the material is guided by the guide wall 46 which, during this movement, is piivoted forwardly by the taut material engaged therewith toward the inclined top wall portion 40. The forwardly-pulling force exerted by the taut material is employed to forwardly push the shaft 52 of the arming means, and to stretch the energy-storing spring 100 to store energy therein for subsequent release. During the continued exertion of the forward pulling force, the sheet material can simultaneously be moved downwardly in the general direction of the arrow B in FIG. 8 toward, but terminating short of, the cutting edge. This combined forward and downward movement by the taut material moves the trigger pin 146 on the release lever 148, which moves forwardly together with the guide wall, and trips the latch member 130, thereby suddenly releasing the stored energy in the spring and driving the drive member 108 forwardly, which action, in turn, raises the cam member 160 with the element 36 from its guarded to its raised cutting position. Optionally, the downward movement can follow the forward pulling movement. The sheet material can then continue to be moved downwardly in the general direction of the arrow B in FIG. 8 onto the raised cutting edge, whereby the sheet material is severed. The cut sheet material, which is now directly over the item 14 being wrapped, is lowered thereon and the wrapping procedure is subsequently completed.

The tripping of the latch member is preferably performed during the beginning of the downward movement of the material, but, in some cases, it may be desirable to trip the latch member after the start of the initial forward movement of the material. In other cases, it may be desirable to arm, i.e. stretch, the spring during the subsequent downward movement, rather than during the initial forward movement. In all cases, it is the force exerted by the taut material and the user through such material during some portion of the movement of the material that is utilized to generate the displacement force, and thereupon to unleash the same to drivingly displace the cutting element. As noted previously, rather than displacing the cutting element, the latter can be fixed to the housing, and it is the guard element that can be displaced by the displacing means of this invention.

Rather than mounting the housing above a supporting surface 16, the dispenser can equally as well be mounted below a supporting surface such as a shelf with the aid of threaded fasteners, clamps or the like, and the withdrawn material can be raised upwardly onto a downwardly extending cutting edge of a cutting element. In still another application, the dispenser can be mounted on a wall in a generally vertical orientation so that the withdrawn sheet material can be guided either toward the right or toward the left onto the cutting edge.

In accordance with another feature of this invention, the sub-chassis 80 and all the components mounted thereon are readily and detachably mounted to the underside of the top wall of the dispenser for easy field replacement and maintenance.

As noted previously, the dispenser has a generally pyramidal shape, having a larger base portion 22 and a smaller top portion 24. The base portion 22 is widest at its lowermost point, and is at least in part upwardly tapered, to provide for increased stability and to prevent tipping of the dispenser. It has been found in some prior art dispensers that when the supply roll is nearly spent, there is a tendency for the dispenser housing to tip over during the withdrawal of the material. This tipping problem sometimes caused the user to throw away the nearly spent roll. However, the very stable construction of the dispenser of the present invention obviates such tipping, even for nearly spent rolls.

The hinged connection of the base 22 and top 24 portions permit the dispenser to be easily loaded. With the top portion opened, a supply roll can be dropped into place in the housing journals, and the free end of the material bunched, and the bunched free end can be routed around the rollers 60, 62, and spread across the same, and thereupon passed through the exit opening 90 by moving the guide wall 46 out of the way.

Turning, finally, to the cutting element 36 itself, as best shown in FIG. 2, it has a generally triangular planar body 172, and a flanged base 174 which constitutes one side of the triangle. The plurality of cutting teeth 170 are arranged in a row along the upper two sides of the triangular body 172. The triangular body 172 has a central apex, and at the end corner regions of the body are provided stop shoulders 180, 182 which, in the cutting position, engage adjacent abutment surfaces on the dispenser so as to provide a positive stop and limit to the upward movement of the cutting element.

Figure 9:
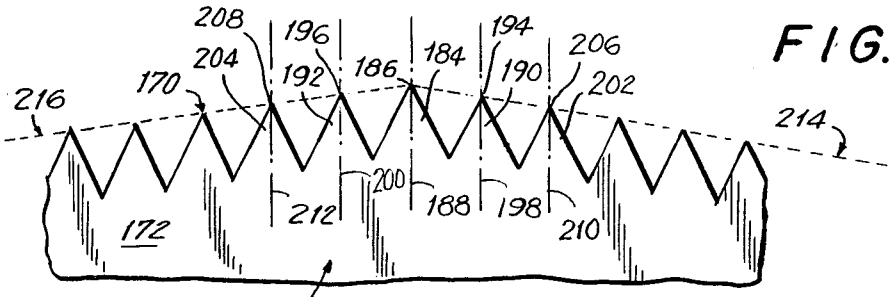
FIG. 9 is a partially broken-away front view of a cutting element of the dispenser.

As best seen in FIG. 9, each tooth has a generally triangular shape with an upper apex. For example, central tooth 184 has an upper apex 186, and is symmetrical about a vertical central axis 188. Adjacent teeth 190, 192, respectively, have upper apices 194, 196 and vertical axes 198, 200 which are preferably parallel to central axis 188. Additional teeth 202, 204, respectively, have upper apices 206, 208 and vertical axes 210, 212 which are preferably parallel to central axis 188. Each tooth is symmetrical about its respective axis. The teeth apices lie on a pair of intersecting imaginary lines 214, 216, neither of which is parallel to the horizontal, such that the teeth apices are vertically spaced apart and are located at different elevations relative to the horizontal.

Each tooth is preferably, but not necessarily, of a large size, typically on the order of $\frac{3}{8}''$ in height as measured perpendicularly along its respective vertical axis from its base to its upper apex, as opposed to prior art cutting elements wherein the teeth apices are arranged colinearly at the same elevation, and wherein the teeth are approximately 1/16" in height.

In the preferred embodiment shown in FIG. 9, as the sheet material is initially urged onto the teeth apices, the central tooth 184 pierces the sheet material first, and thereupon the adjacent teeth 190, 192 at either side of, and at a lower elevation relative to, the central tooth 184 pierce the sheet material and, in turn, succeeding teeth 202, 204 on either side of the teeth 190, 192, and at a still lower elevation relative thereto, sequentially pierce the sheet material at spaced-apart locations along the width of the material.

As the sheet material is continued to be urged downwardly, each piercing or puncture widens in width until, eventually, adjacent punctures merge with one another, and the entire width of the material has been cut. To even further facilitate the piercing action, each tooth need not be strictly planar, but may be flared in the transverse direction to form a spear-like tip.

Other configurations for the cutting element are, of course, possible, it being understood that, in the preferred case, the apices of the cutting teeth should be located at differing elevations above the supporting surface 16 so as to achieve the sequential piercing and cutting action described above. Also, it is preferable if the axes of the teeth are parallel to one another and are all vertical. This insures that the first contact between the sheet material and any particular tooth will be at the apex of the same, rather than along a side of the tooth.

In a preferred embodiment for cutting sheet material of 12" width, the teeth are arranged four to the inch (¼ pitch), and about forty-nine teeth are arranged in a row. Each tooth has an apex angle of about 36°, and the lines 214, 216 on which the apices lie define an angle of about 10° relative to the horizontal. The cutting element is preferably made of spring steel of 10 mil thickness, although other hard materials, such as plastic, also can be employed.

It will be understood that each of the elements described above, or two or more together, may also find a useful application in other types of arrangements differing from the type described above.

While the invention has been illustrated and described as embodied in a sheet wrapping material dispenser, a method of dispensing wrapping stock, and a method of wrapping items, it is not intended to be limited to the details shown, since various modifications and structural changes may be made without departing in any way from the spirit of the present invention. For example, the dispenser need not be used for wrapping purposes, and can equally as well be used for non-wrapping purposes, such as a paper towel or toilet paper dispenser.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspect of our contribution to the art and, therefore, such adaptations should and are intended to be comprehended within the meaning and range of equivalence of the claims.

What is claimed as new and desired to be protected by Letters Patent is set forth in the appended claims:

1. A sheet wrapping material dispenser, comprising:

(a) a support;

(b) an elongated cutting element on the support;

(c) a guard element on the support;

(d) means for mounting a supply of elongated sheet wrapping material on the support to permit a free end portion of the material to be grasped by a user, and for paying out a desired length of the material when the latter is manually withdrawn from the dispenser;

(e) means for restraining the withdrawal of the desired length of the material for tautening the latter during withdrawal;

(f) means for guiding the taut length of the material for movement transversely past and spaced from the cutting element, and thereupon toward and onto the cutting element; and (g) means for displacing at least one of the elements relative to the other in response to the movement of the taut length of the material, including (i) arming means for generating a displacement force in response to one portion of the movement of the taut length of the material, (ii) latch means for normally latching said at least one element against displacement in a normally guarded position in which the guard element renders the cutting element inoperative for cutting, and (iii) release means for releasing the latch means, and for unleashing the displacement force in response to another portion of the movement of the taut length of the material to drivingly displace said at least one element from the guarded position to a cutting position in which the cutting element is positioned to cut the material guided thereonto.

2. The dispenser as recited in claim 1, wherein the support includes a base portion and a top portion which together bound an interior space for receiving the material supply, said top portion being mounted on the base portion for movement relative thereto between an open and a closed position to respectively gain and deny access to the material supply within the support.

3. The dispenser as recited in claim 2, wherein the top portion of the support is pivotably mounted on the base portion, and further comprising means for locking the top and base portions with a snap-type action in the closed position.

4. The dispenser as recited in claim 1, wherein the material mounting means includes a roll mounted on the support for rotation about an axis extending generally parallel to the elongation of the cutting element, and wherein the material is wrapped around the roll.

5. The dispenser as recited in claim 1, wherein the support has wall portions bounding an interior space for receiving the material supply, and wherein the guiding means includes an exit opening extending from the interior space to the exterior of the dispenser and through which the taut length of the material passes, and wherein the cutting element is substantially planar, and wherein the taut length of the material downstream of the exit opening generally lies in a plane which is substantially normal to the plane of the cutting element in the cutting position.

6. The dispenser as recited in claim 5, wherein the support has an inclined top wall which is substantially normal to the plane of the cutting element, and wherein the taut length of the material is guided towards the inclined top wall after the movement past and spaced from the cutting element.

7. The dispenser as recited in claim 1, wherein the support includes an upright wall, and wherein the guiding means includes a movable guide wall mounted on the support for movement from a clamping position in which the free end portion of the material is resiliently pressed between the upright wall and the movable guide wall, to a plurality of non-clamping positions in which the taut length of the material is guided on and along the guide wall.

8. The dispenser as recited in claim 7; and further comprising means for constantly restorably urging the movable guide wall to the clamping position.

9. The dispenser as recited in claim 1. wherein the guiding means includes a movable guide wall having a pair of spaced-apart notches in which the free end portion of the material may be grasped at spaced-apart locations across the width of the material to permit the user to pull the material from the support with both hands safely out of the way of the cutting element.

10. The dispenser as recited in claim 1, wherein the cutting element has means for sequentially piercing the taut length of the material guided thereonto in the cutting position, said sequential piercing means constituting a plurality of juxtaposed pointed cutting teeth arranged lengthwise along the cutting element and having apices of different elevations for cutting the taut length of the material over its entire width in a motion perpendicular to the plane of the taut length of the material and toward and past the cutting teeth.

11. The dispenser as recited in claim 10, wherein the cutting element has an intermediate portion and a pair of opposite end portions, and wherein the teeth at the intermediate portion have the most elevation, and wherein the teeth at each end portion have the least elevation, and wherein the teeth between the intermediate and end portions gradually decrease in elevation in the direction from the intermediate portion to each end portion.

12. The dispenser as recited in claim 10, wherein the guard element is integral with the support, and wherein the cutting element constitutes said at least one displaceable element.

13. The dispenser as recited in claim 1, wherein the arming means includes means for storing energy in response to the guided movement of the taut length of the material past and spaced from the cutting element, and wherein the release means abruptly releases the stored energy in response to a subsequent guided movement of the taut length of the material toward the cutting element.

14. The dispenser as recited in claim 13, wherein the energy storing means constitutes an elongated spring, and wherein the latch means is operatively connected to one end portion of the spring to anchor the latter in the guarded position, and wherein the arming means is operatively connected to the opposite end portion of the spring to move the latter and stretch the spring for storing energy therein.

15. The dispenser as recited in claim 14, wherein the support has an exit opening through which the material is withdrawn from the dispenser, and wherein the arming means further includes an arming member engaging the material intermediate the supply and the exit opening, said arming member being mounted on the support and being moved by the material engaging the arming member as the material is withdrawn from an unarmed to an armed position to thereby increasingly stretch the spring.

16. The dispenser as recited in claim 15, wherein the material mounting means includes a roll mounted on the support for rotation about an axis, and wherein the arming member extends axially lengthwise of the roll and has a pair of opposite axial end arms pivotably mounted on the support; and further comprising means operatively engaging the arms for constantly restorably urging the arming member to its unarmed position.

17. The dispenser as recited in claim 15, wherein the latch means includes a force-transmitting member operatively connected to said one end portion of the spring, and having an abutment displaceable by the spring along a displacement path, a movable latch member mounted on the support for movement between a latched and an unlatched position in which the latch member is respectively positioned in and remote from the displacement path of the abutment, and means for constantly restorably urging the movable latch member to the latched position.

18. The dispenser as recited in claim 17, wherein the release means includes an actuator member movable in response to the withdrawal of the taut length of the material into the path of movement of the latch member to engage and drive the same from the latched to the unlatched position.

19. The dispenser as recited in claim 18, wherein the actuator member is mounted on the guiding means for joint movement therewith.

20. The dispenser as recited in claim 17, wherein the displacing means includes a cam member operatively connected to the cutting element for joint movement therewith and engageable with the force-transmitting member to be displaced by the same when the displacement force is unleashed.

21. The dispenser as recited in claim 20, wherein the cam member has a pair of side rails spaced apart from each other to define a space in which a guide projection of the force-transmitting member is slidingly received to prevent undesired shifting lengthwise of the cutting element during the displacement.

22. The dispenser as recited in claim 20, wherein the cam member has a pair of locking shoulders which engage the force-transmitting member in the cutting position and maintain the cutting element in the cutting position during cutting of the sheet material.

23. The dispenser as recited in claim 1; and further comprising a safety cover mounted on the support for movement between a safety position in which the cover overlies said at least one displaceable element to prevent displacement thereof, and an operating position wherein said at least one displaceable element is left free to be displaced.

24. The dispenser as recited in claim 1, wherein the release means is operative to suddenly release the latch means after the displacement force has been built up to a predetermined magnitude and after the free end portion of the material has been withdrawn past the cutting element to cause said at least one displaceable element to be abruptly displaced with a pop-up action.

25. A sheet material dispenser, comprising:

(a) a support;

(b) an elongated cutting element on the support;

(c) a guard element on the support;

(d) means for mounting a supply of elongated, limp, non-self-supportable, thin, broad sheet material on the support to permit a free end portion of the material to be grasped by a user, and for paying out a desired length of the meterial when the latter is manually withdrawn from the dispenser;

(e) means for restraining the withdrawal of the desired length of bhe material for tautening the latter during withdrawal;

(f) means for guiding the taut length of the material for initial movement transversely past and spaced from the cutting element, and thereupon for subsequent movement towards and past a trigger position, and then onto the cutting element: and (g) means for maintaining at least one of the elements in a normally guarded position in which the guard element renders the cutting element inoperative for cutting upon movement of the taut length of the material until just prior to reaching the trigger position, and thereupon for abruptly displacing said at least one element relative to the other upon movement of the taut length of the material to the trigger position, to a cutting position in which the cutting element is positioned to cut the taut length of the material guided thereonto, said cutting position being maintained upon movement of the taut length of the material past the trigger position and onto the cutting element.

26. A sheet wrapping material dispenser, comprising:

(a) a housing having a front guard wall, a rear wall and side walls together bounding an interior space;

(b) an elongated cutting element having cutting teeth and being mounted on the housing adjacent the front guard wall for movement between a normally guarded position in which the teeth are shielded by the front guard wall, and a cutting position in which the teeth extend beyond the front guard wall;

(c) a supply of elongated, limp, non-self-supportable, thin, broad sheet wrapping material in the interior space of the housing to permit a free end portion of the material to be grasped by a user, and to withdraw a desired length of the material from the interior space to the exterior of the housing;

(d) means for restraining the withdrawal of the desired length of the material for tautening the latter during withdrawal;

(e) means for guiding the taut length of the material for movement generally forwardly toward the cutting element and past the same to a position spaced from the cutting element, and subsequently from the spaced position toward and onto the cutting teeth; and (f) means for displacing the cutting element from its normally guarded position to its cutting position, said displacing means including (i) means for storing energy by the forward movement of the taut length of the material to spaced position, and (ii) means for releasing the stored energy by the subsequent movement of the taut length of the material toward the cutting teeth, and for drivingly displacing the cutting element to its cutting position prior to the taut length of the material making contact with the cutting teeth.

27. A sheet material dispenser, comprising:

(a) a support;

(b) an elongated cutting element on the support;

(c) a guard on the support;

(d) means for mounting a supply of elongated, limp, non-self-supportable, thin, broad sheet material on the support, said sheet material having a transverse width and side edges spaced transversely apart by a distance at least equal to eight inches, said mounting means being operative during each use of the dispenser for successively paying out a desired length of the material when a successive leading end portion of the material is manually grasped by a user at transversely spaced-apart locations along the width of each leading end portion adjacent the sides edges of the material, and when the desired length of the material is manually withdrawn from the supply:

(e) means for restraining the withdrawal of each successively withdrawn length of the material for tautening the same during withdrawal;

(f) means for guiding each taut length of the material for generally forward movement to a position spaced above the cutting element, and thereupon for generally downward movement from the spaced position past a trigger position and onto the cutting element; and (g) means for maintaining at least one of the cutting element and the guard in a guarded position in which the cutting element is shielded upon movement of each taut length of the material until just prior to reaching the trigger position, and thereupon for abruptly displacing said at least one of the cutting element and the guard relative to the other upon movement of each taut length of the material to the trigger position, to a cutting position in which the cutting element is positioned to cut each taut length of the material downwardly guided thereonto, said cutting position being maintained upon movement of each taut length of the material past the trigger position and onto the cutting element.

28. The dispenser as recited in claim 27, wherein said displacing means includes means in engagement with each taut length of the material for storing energy due to the forward movement, and means for abruptly releasing the stored energy due to the downward movement of each taut length of the material, and for drivingly displacing the at least one of the cutting element and the guard to the cutting position prior to each taut length of the material making contact with the cutting element.

29. A sheet material dispenser, comprising:

(a) a support for supporting the dispenser on a generally horizontal support surface;

(b) an elongated cutting element on the support and having a plurality of pointed, sharp cutting teeth arranged along the cutting element, said teeth having apices, adjacent ones of which are at different vertical elevations relative to the support surface, said teeth having vertical axes at the tops of which the apices are located, said vertical axes being parallel to one another, each tooth being symmetrical about its respective vertical axis;

(c) a guard on the support;

(d) means for mounting a supply of elongated, limp, non-self-supportable, thin, broad sheet material on the support to permit successive leading end portions of the material to be grasped by a user adjacent opposite side edges thereof, and for successively paying out a desired length of the material upon manual withdrawal of the same from the supply;

(e) means for restraining the withdrawal of each successively withdrawn length of the material for tautening the same during withdrawal;

(f) means for guiding each taut length of the material for movement transversely past and spaced from the cutting element, and thereupon toward and past a trigger position, and then onto the cutting teeth; and (g) means for maintaining at least one of the cutting element and the guard in a guarded position in which the cutting teeth are shielded upon movement of each taut length of the material until just prior to reaching the trigger position, and thereupon for abruptly displacing said at least one of the cutting element and the guard relative to the other upon movement of each taut length of the material to the trigger position, to a cutting position in which the cutting teeth sequentially pierce each taut length of the material guided onto the cutting teeth at a plurality of punctures spaced over the transverse width of the respective taut length of the material, each puncture uniformly widening in width and merging with adjacent punctures during the movement of each taut length of the material onto the cutting element to form a complete transverse cut, said cutting position being maintained upon movement of each taut length of the material past the trigger position and onto the cutting element.

30. A sheet material dispenser, comprising:

(a) a support;

(b) an elongated cutting element on the support;

(c) a guard on the support;

(d) a supply of elongated, limp, non-self-supportable, thin, broad sheet material having successive leading end portions each having a transverse width and side edges;

(e) means for positioning each leading end portion in an accessible position behind the guard and above the support to permit successive leading end portions of the material to be readily grasped by a user at transversely spaced-apart locations along the width of each leading end portion adjacent the sides edges of the material;

(f) means for mounting the supply for successively paying out a desired length of the material upon manual withdrawal of the same from the supply;

(g) means for restraining the withdrawal of each successively withdrawn length of the material for tautening the same during withdrawal;

(h) means for guiding each taut length of the material for generally forward movement from the accessible position to a position spaced above the cutting element, and thereupon for generally downward movement from the spaced position past a trigger position and onto the cutting element; and (i) means for maintaining at least one of the cutting element and the guard in a guarded position in which the cutting element is shielded upon movement of each taut length of the material until just prior to reaching the trigger position, and thereupon for abruptly displacing said at least one of the cutting element and the guard relative to the other upon movement of each taut length of the material to the trigger position, to a cutting position in which the cutting element is positioned to cut each taut length of the material downwardly guided thereonto, said cutting position being maintained upon movement of each taut length of the material past the trigger position and onto the cutting element.

31. A dispenser, comprising:

(a) a housing having a base supportable on a generally planar horizontal support surface, and a top located above the base, said housing having wall portions bounding an interior, and an opening which extends from the interior to the exterior of the housing;

(b) an elongated cutting element having a plurality of sharp cutting teeth arranged along the length of the cutting element, said cutting element being mounted on the housing for movement between a guarded position in which the teeth are located within the housing, and a cutting position in which the teeth project beyond the housing;

(c) a roll mounted within the interior of the housing for turning movement about a generally horizontally-extending axis, said roll having a coiled, continuous supply of thin, broad, synthetic plastic film wound about the axis, and unwindable during each use of the dispenser for successively paying out a desired film length having a leading end portion along a path from the interior of the housing through the opening to the exterior of the housing;

(d) means at the top of the housing for positioning each leading end portion in an accessible position behind the guarded cutting element and above the housing to permit successive leading end portions of the film to be grasped readily by a user at transversely spaced-apart locations along the transverse width of each leading end portion;

(e) means for guiding each leading film length for manual withdrawal from the accessible position in a generally forward direction toward and past the cutting element to an elevated position above the same, and thereupon for generally downward movement from the elevated position toward and past a trigger position, and then onto the cutting element in a direction toward the base;

(f) means for exerting a drag on each film length for tautening the same during said withdrawal and said downward movement; and (g) means for maintaining the cutting element in the guarded position during said withdrawl until just prior to reaching the trigger position, for abruptly displacing the cutting element to the cutting position during said downward movement to the trigger position prior to each taut film length making contact with the cutting teeth, and for maintaining the cutting element in the cutting position during said downward movement past the trigger position and onto the cutting element until each taut film length is completely cut across its width.

32. A method of dispensing sheet wrapping material, comprising the steps of:

(a) mounting an elongated cutting element having cutting teeth on a housing for movement between a normally guarded position in which the cutting teeth are shielded by the housing, and a cutting position in which the cutting teeth are exposed;

(b) grasping a free end portion of an elongated, limp, non-self-supportable, thin, broad sheet wrapping material mounted in the housing, and pulling out a desired length of the material in a taut condition;

(c) guidably moving the taut material during the pulling-out step initially in a generally forward direction toward the cutting element and past the same to a position spaced from the cutting element, and subsequently moving the taut withdrawn material in a general direction from the spaced position toward the cutting teeth;

(d) displacing the cutting element from its normally guarded position to its cutting position, including the step of storing energy due to the initial forward movement of the taut material to the spaced position, and the step of releasing the stored energy due to the subsequent movement of the taut material prior to the latter making contact with the cutting teeth.

33. The method as recited in claim 32, wherein the grasping and pulling step is performed by grasping spaced-apart portions of the free end portion.

* * * * *